US005240456A

United States Patent [19]

Ochiai

[11] Patent Number: 5,240,456

[45] Date of Patent: Aug. 31, 1993

[54] SET OF FORMS WITH OMR CARD FOR DELIVERING PACKAGE

[75] Inventor: Hidehiro Ochiai, Yokohama, Japan

[73] Assignee: Matsushita Electric Industrial Co., Ltd., Osaka, Japan

[21] Appl. No.: 863,222

[22] Filed: Apr. 3, 1992

[30] Foreign Application Priority Data

Apr. 8, 1991 [JP] Japan ..... 3-074954

[51] Int. Cl.[5] ..... B41L 1/22

[52] U.S. Cl. ..... 462/67; 283/73; 283/79; 283/81

[58] Field of Search ..... 283/73, 79, 80, 81; 402/67

[56] References Cited

U.S. PATENT DOCUMENTS

| | | | |
|---|---|---|---|
| 1,684,756 | 9/1928 | Close | 462/67 |
| 3,648,838 | 3/1972 | Hiromura | 283/81 X |
| 3,774,758 | 11/1973 | Sternberg | 283/73 X |
| 3,987,960 | 10/1976 | Gardiner | 283/79 X |
| 4,407,524 | 10/1983 | Trautlein | 283/79 X |
| 4,614,361 | 9/1986 | Foster | 283/79 X |
| 4,688,826 | 8/1987 | Hosoya | 283/79 X |
| 4,941,685 | 7/1990 | Anderson | 462/67 |
| 4,978,145 | 12/1990 | Mikhail | 283/81 X |

FOREIGN PATENT DOCUMENTS

| | | | |
|---|---|---|---|
| 58-7353 | 2/1983 | Japan . | |
| 2120996 | 5/1990 | Japan . | |
| 8803480 | 5/1988 | PCT Int'l Appl. | 462/67 |

*Primary Examiner*—Paul A. Bell

*Attorney, Agent, or Firm*—Stevens, Davis, Miller & Mosher

[57] ABSTRACT

A set of forms having an OMR card for delivering packages is provided. Substantially all or part of information indicated on these forms can be input into a machine, without depending upon manual processing or with hardly changing the conventional process for manufacturing such forms or the method of filling them in.

At least one of these forms is the OMR card. Of information to be written on the forms, information used for calculating the sending fee, such as the name and category of items, and the delivery substation code, is indicated by selectively marking characters, numerals, symbols or pictures, which have already been printed in a blank for marking these indicators. Location ID marks are printed on the card so that an OMR can read the marks.

3 Claims, 2 Drawing Sheets

SET OF FORMS WITH OMR CARD FOR DELIVERING PACKAGE

BACKGROUND OF THE INVENTION

1. Field of the Invention

The present invention relates to a set of forms used by a delivery company to handle the home or office delivery of packages or for making a duplicate copy for the sender, when the packages are sent.

2. Description of the Related Art

Conventionally, a plurality of forms for delivering packages are laid one on top of another and bound together. Printed on each form are blanks for writing the destination and the sender, a blank for writing the name and category of items, delivery substation codes, etc., information used for calculating the sending fee, a form number for identifying the forms, and a bar code representing the form number. Except for the last form, a copying medium, such as carbon, is applied to the undersurfaces of all the forms. When a ball-point pen or the like is used to fill in the top form, what is written on the top form is duplicated on the other forms.

All or some of the forms have an adhesive portion which sticks to the package. These forms are used for the delivery company to handle the package, and one of them is used as a duplicate copy for the sender.

In most cases, the forms are written by hand. When information written on the forms is input into a machine, such as a computer, the operator reads and inputs the information through a keyboard of the terminal of the machine. Even when the keyboard is not used to input the information written on the forms, at best the form number as a bar code can be input by using a light pen.

As mentioned above, conventionally, of all the types of information written on the forms, the bar code representing the form number is the easiest to input since it can be done without using the keyboard. When the other information, such as the name and category of items, and the delivery substation code, are input into a machine, like a computer, the operator himself has to read and input the information through the keyboard. For this reason, as home and office delivery of packages increases in number as well as the number of forms to be processed, the amount of work to input information regarding the packages increases and so does the number of errors.

SUMMARY OF THE INVENTION

The present invention solves the above conventional problems. The object of this invention is to provide a set of forms having an OMR card for home and office delivery of packages, substantially all or part of the information written on which forms can be input into a machine, without depending upon manual processing or with hardly changing the conventional process for manufacturing such forms or the method of filling them in.

To achieve the above object, on a set of forms for home or office delivery of package, blanks for writing the destination and the sender are printed substantially the same as the conventional manner. A blank for marking the name and category of items, a delivery substation code, etc., information used for calculating the sending fee, is printed differently from the conventional manner, that is, printed in the form of characters, numerals, symbols or pictures which can be read by an Optical Mark Reader (OMR). The required information regarding the package is provided by selectively indicating the marks in the marking blank. A form number for identifying the forms and a bar code representing the form number are printed in the conventional manner. The set of forms is assembled by binding a plurality of forms on which all the information mentioned above is printed. Except for the last form, a copying medium, such as carbon, is applied to the undersurfaces of the forms so that what is written on the top form is duplicated on the remaining forms. All or some of the forms have an adhesive portion which sticks to the package. Of all the forms, at least one is an OMR card having a thickness substantially equal to that of a post card. Location ID marks are printed in the marking blank so that the OMR can read the OMR card.

According to this invention, the user of these forms writes the destination and the sender on the top form with a ball-point pen or the like in the same manner as with the conventional forms. He also marks information used for calculating the sending fee in the marking blank, such as the name and category of items, and the delivery substation code. The marking blank is completed by marking the characters, numerals, or pictures. This marking is duplicated on the OMR card which is read by the OMR. In this way, the information used for calculating the sending fee, such as the name and category of items, and the delivery substation code, can be input.

DESCRIPTION OF THE PREFERRED EMBODIMENT

Figure 1:
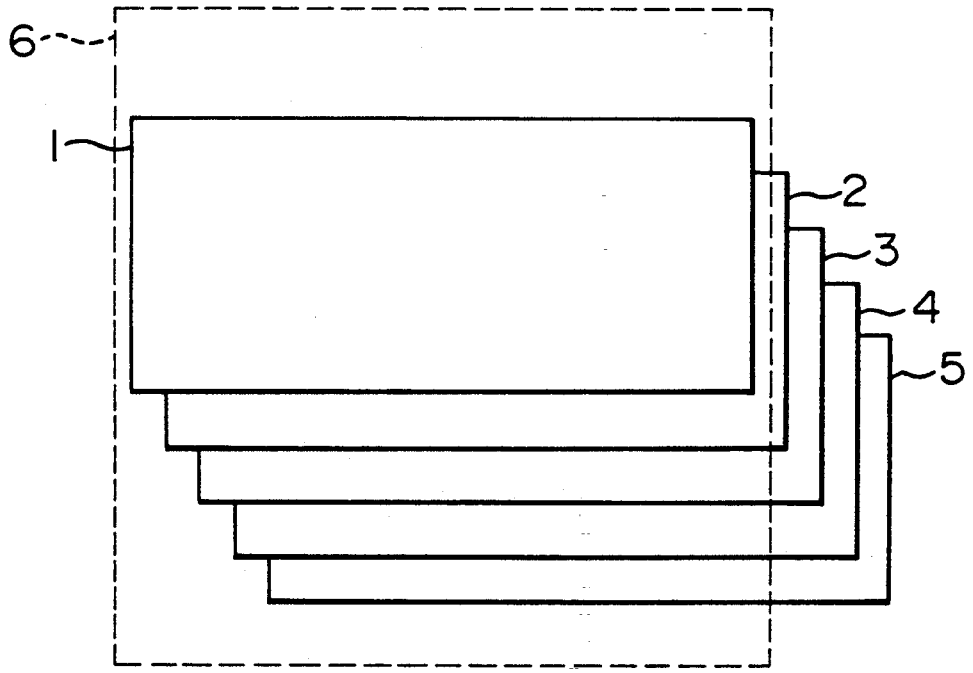
FIG. 1 is a view showing the composition of an embodiment of a set of forms for delivering packages according to this invention.
Figure 2:
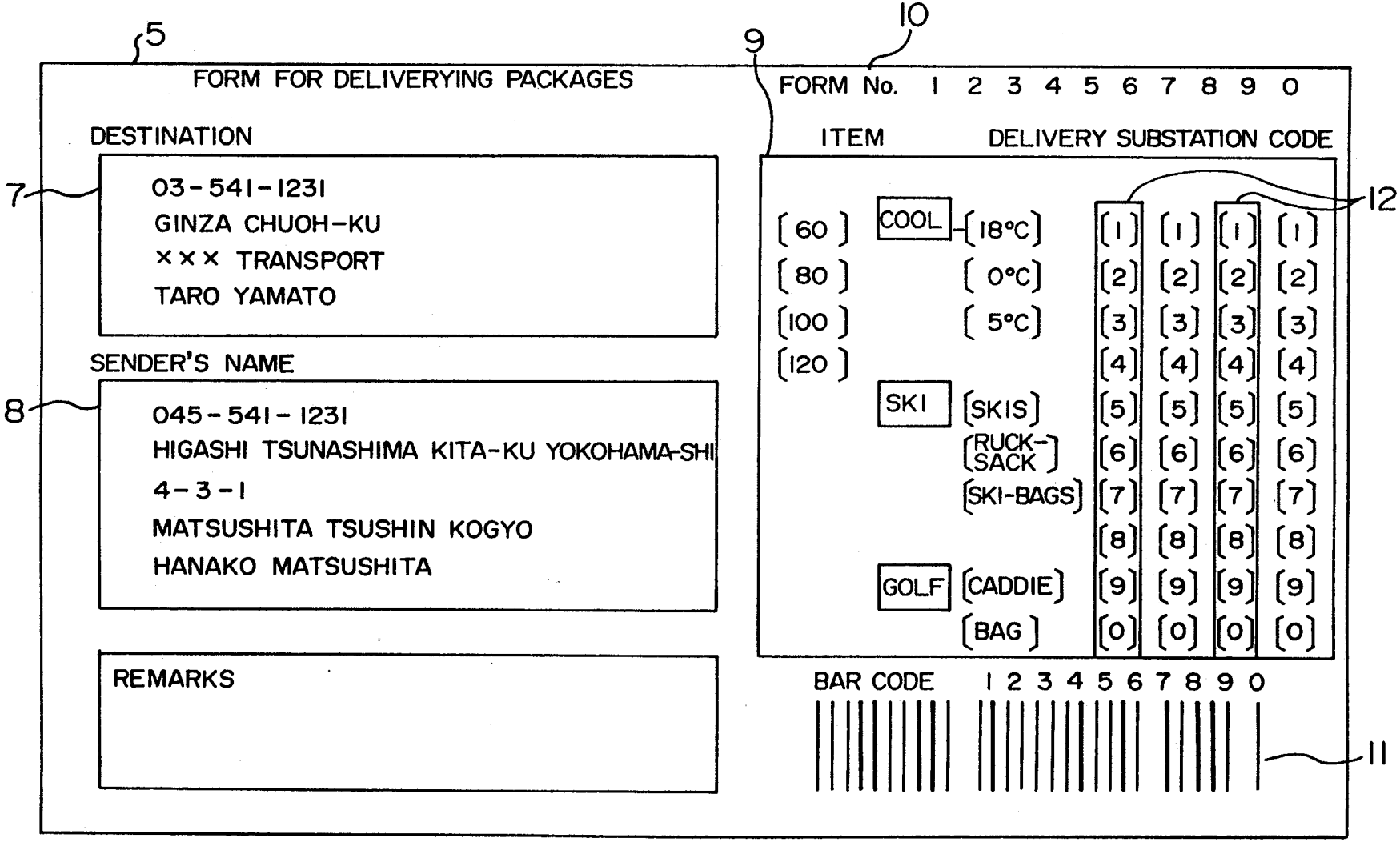
FIG. 2 is a view showing the composition of an OMR card included in the set of forms according to this invention.

As shown in FIG. 1, a set of five forms 1 to 5 for home or office delivery of packages according to an embodiment of this invention is composed by binding the five forms 1 to 5, and is attached to the undersurface of a transparent sheet 6. The transparent sheet 6 has an adhesive portion which sticks to a package. The last form of the five forms 1 to 5 is a card 5 used for Optical Mark Reader (OMR) purposes, and has a thickness substantially equal to that of a post card. Substantially the same information is printed on all the forms 1 to 5. There is a space in a blank 7 for writing the name, address, etc. of the receiver. Similarly, there is a space in a blank 8 for writing the name, address, etc. of the sender.

The name of items and delivery substation codes used for calculating the sending fee are printed in either characters or numerals in a marking blank 9. The marking blank 9 is completed by marking the characters or numerals with a ball-point pen or the like with a check such as a circle or an "X". Instead of characters or numerals, symbols, or simple pictures or patterns may also be employed. Information regarding a package, such as the size, the weight, whether the package is fragile, and whether it is packed in a box or a bag, can be provided by using the above marks. It is possible to write a portion of what is written in the receiver and sender blanks 7 and 8 into the marking blank 9. It is possible that, for example, all the administrative divisions of Japan be shown in a map of Japan, and a destination to which a package is sent can be marked with a circle or an "X". Also, the telephone numbers of the receiver and the sender can be easily written into the marking blank 9.

A form number 10 for identifying a set of forms and a bar code 11 representing the form number 10 are printed in the same manner as the conventional manner. A copying medium, such as carbon, is applied to the undersurface of each of the first to the fourth forms 1 to 4. When the first form is written with a ball-point pen, what is written on the first form is duplicated on the remaining forms 1 to 4, thus completing all the forms. The transparent sheet 6 has the adhesive portion in the upper part thereof. When the adhesive portion is stuck to a package, the five forms 1 to 5 can be attached to the package while these forms remain beneath the transparent sheet 6. In addition to the sender blank 7, the receiver blank 8, the marking blank 9, the form number 10, and the bar code 11, all of which are printed, location ID marks 12 for OMR purposes are printed in the marking blank 9 of the OMR card 5.

Because of the location ID marks 12, an OMR can easily identify and read the information indicated in the marking blank 9.

The operation of the above embodiment will now be described. The user of these forms writes with a ball-point pen or the like the address, name, telephone number, etc. of the receiver in the receiver blank 7. Likewise, he writes the address, name, telephone number, etc. of the sender in the sender blank 8. For instance, when a golf bag is sent, the items "golf" and "bag" are marked with, e.g., a circle.

The first to forth forms of the five forms 1 to 5 are used as one duplicate copy for the sender, and the others for the delivery company to handle the package. However, the last form, which is the OMR card 5, is read by an OMR. The OMR reads not only the name of items and the delivery substation code, but also the bar code 11 representing the form number, thereby improving the efficiency of inputting the information indicated on the card 5.

As obvious from the above embodiment, substantially all or part of the information written on a set of forms for home or office delivery of packages can be mechanically read by an OMR with hardly changing the method of using such conventional forms, that is, without changing the method of filling them in. It is thus made easy to process information regarding home and office delivery of packages which will be expected to increase. The processes for manufacturing forms, such as those of shaping, constructing, and printing the forms, are the same as those for the conventional forms. It is therefore not necessary to modify machines and processes for manufacturing the forms. Moreover, OMRs are devices for inputting data which is easy to process, and are more inexpensive and can be made smaller than Optical Character Readers (OCRs). Since the OMR can be made smaller, it is convenient to carry it in order to process the OMR card.

What is claimed is:

1. A set of forms for use in delivery of a package, comprising:

a plurality of forms bound together, at least one of the plurality of forms being an optical mark reader card;

each of the plurality of forms having indicia printed thereon that are capable of being selectively marked to convey information comprising a name and category of the package and a delivery substation code;

the optical mark reader card having location marks printed thereon so that an optical mark reader can read the optical mark reader card; and a copying medium applied to undersurfaces of all of the plurality of forms except a last one of the plurality of forms.

2. A set of forms as in claim 1, further comprising a transparent sheet bound with the plurality of forms and an adhesive portion on the transparent sheet, whereby the set of forms can be attached to the package to provide shipping information for the package.

3. A set of forms for use in delivery of a package, the set of forms comprising:

(a) a plurality of forms bound together, at least one of the plurality of forms being an optical mark reader card, each one of the plurality of forms having printed thereon:

(i) a blank for writing information concerning a sender;

(ii) a blank for writing information concerning a destination;

(iii) a form number for identifying the set of forms;

(iv) a bar code representing the form number; and (v) a marking blank including printed indicia capable of being selectively marked to represent information comprising a name and category of the package and a delivery substation code, the optical mark reader card also having printed thereon location identification marks so that an optical mark reader can read the optical mark reader card;

(b) a copying medium applied to undersurfaces of all of the plurality of forms except a last one of the plurality of forms, whereby information written on a first one of the plurality of forms is duplicated onto all of the plurality of forms except the first one; and (c) an adhesive portion on at least one of the plurality of forms, whereby the set of forms can be attached to the package to provide shipping information for the package;

whereby an optical mark reader can read data written on the set of forms and can determine a shipping fee for the package.

* * * * *